US010923090B1

(12) United States Patent
Boxberger

(10) Patent No.: US 10,923,090 B1
(45) Date of Patent: Feb. 16, 2021

(54) MUSIC EFFECTS PEDALBOARD WITH A BUILT-IN HIDDEN PATCH CORD

(71) Applicant: Frank Dale Boxberger, Scottsdale, AZ (US)

(72) Inventor: Frank Dale Boxberger, Scottsdale, AZ (US)

( * ) Notice: Subject to any disclaimer, the term of this patent is extended or adjusted under 35 U.S.C. 154(b) by 0 days.

(21) Appl. No.: 16/852,185

(22) Filed: Apr. 17, 2020

Related U.S. Application Data

(60) Provisional application No. 62/810,289, filed on Feb. 25, 2019.

(51) Int. Cl.
*G10H 1/34* (2006.01)

(52) U.S. Cl.
CPC ..... *G10H 1/348* (2013.01)

(58) Field of Classification Search
CPC ..... G10H 1/348
USPC ..... 84/746
See application file for complete search history.

(56) References Cited

U.S. PATENT DOCUMENTS 3,433,881 A * 3/1969 Cotten ..... G10H 1/32 84/721
6,215,055 B1 * 4/2001 Saravis ..... G10H 1/348 84/422.1
6,459,023 B1 * 10/2002 Chandler ..... G10H 1/32 84/177
8,642,870 B1 * 2/2014 Rosa ..... G10G 7/005 84/453
9,659,553 B1 * 5/2017 Lawrence ..... G10H 1/348
10,192,536 B1 * 1/2019 Jia ..... G10H 1/0008
10,380,984 B1 * 8/2019 Calder ..... G10H 1/32
10,395,631 B1 * 8/2019 Boxberger ..... G10H 1/0555
10,621,964 B1 * 4/2020 Boxberger ..... G10H 1/348
10,657,940 B1 * 5/2020 Calder ..... G10H 1/0008
10,706,828 B2 * 7/2020 Christian ..... G10H 3/186
2004/0250673 A1 * 12/2004 Salerno ..... G10H 1/348 84/746
2011/0271821 A1 * 11/2011 McKinney ..... G10H 1/348 84/746
2016/0293151 A1 * 10/2016 Mayo ..... G10H 1/0058
2017/0206879 A1 * 7/2017 Fiden ..... G10H 1/348
2018/0151162 A1 * 5/2018 McKenzie ..... G10H 1/348
2019/0103086 A1 * 4/2019 Christian ..... H01M 10/0525
2019/0287504 A1 * 9/2019 O'Brien ..... G10H 1/348

* cited by examiner

*Primary Examiner* — David S Warren
*Assistant Examiner* — Christina M Schreiber
(74) *Attorney, Agent, or Firm* — Plager Schack LLP; Mark H. Plager; Eric Liou

(57) ABSTRACT

A music pedalboard having a built-in patch cord and designed for use with a plurality of effects pedals is provided. The pedalboard includes a board designed to receive a first set of effects pedals arranged along a first row on the board and a second set of effects pedals arranged along a second row on the board, and a patch cord coupled to the bottom face of the board and having a first end coupled to a first side face of the board and a second end coupled to a second opposing side face of the board. The first end of the patch cord operably connects to an output of a last effects pedal in the first set of effects pedals and the second end of the patch cord operably connects to an input of a first effects pedal in the second set of effects pedals.

7 Claims, 2 Drawing Sheets

MUSIC EFFECTS PEDALBOARD WITH A BUILT-IN HIDDEN PATCH CORD

RELATED APPLICATION

The application claims priority to provisional patent application U.S. Ser. No. 62/810,289 filed on Feb. 25, 2019, the entire contents of which is herein incorporated by reference.

BACKGROUND

The embodiments herein relate generally to music effects pedalboards. More specifically, embodiments of the invention are directed to a music effects pedalboard with a built-in patch cord.

The sound of musical instruments such as guitars is often modified using an effects pedal, such as a Wah Wah pedal, fuzz pedal, distortion pedal, overdrive pedal, delay pedal, reverb pedal, volume pedal or other effects pedal. Often times, multiple effects pedals with different effects are used together by a musician and mounted to a single board called a pedal board or pedalboard.

The plurality of effects pedals are typically arranged on top of the pedalboard in a plurality of adjacent rows. The first effects pedal in the first row of effects pedals is connected to the guitar or other instrument by a patch cord. The output of the first effects pedal is connected to the input of the next effects pedal in the first row of effects pedals by a patch cord. Additional patch cords are used in the same manner to connect adjacent pairs of effects pedals in all rows of effects pedals on the pedalboard.

Connecting the output of the last effects pedal in the first row of effects pedals to the input of the first effects pedal in the successive row of effects pedals is problematic because these pedals are located on opposite sides of the pedalboard. As a result, a patch cord connecting these two effects pedals has to extend above the top of the pedalboard and over, through and/or around the plurality of effects pedals on the pedalboard. This patch cord with slack can easily get stuck on one or more effects pedals, tangled with other connecting patch cords present between effects pedals on the pedalboard, or collect on the ground as a tripping hazard.

These issues can also interfere with the ability of one or more effects pedals on the pedalboard from operating properly. For example, slack in the patch cord can get caught within an effects pedal, preventing the pedal from being turned on, off or working properly. Further, the presence of the patch cord extending alongside the plurality of effects pedals on the pedalboard can increase the likelihood for interference in the form of noise and hum that is added to the guitar's generated sound.

Several effects pedalboards exist as disclosed in U.S. Pat. No. 10,380,984 and U.S. Patent Application Publications 2019/0287504 and 2018/0151162, which disclose pedalboards that facilitate the connections between effects pedals. However, these pedalboards do not address the issues previously highlighted when connecting the last effects pedal in a row of effects pedals on the pedalboard with the first effects pedal in the successive row of effects pedals on the pedalboard.

As such, there is a need in the industry for a music effects pedalboard with a built-in hidden patch cord that addresses the limitations of the prior art.

SUMMARY

In certain embodiments, a music pedalboard having a built-in patch cord and configured for use with a plurality of effects pedals is provided. The music pedalboard is configured to allow the plurality of effects pedals to be coupled thereto and arranged in a plurality of rows on the pedalboard. The pedalboard comprises a board comprising a top face, a bottom face opposite the top face, a first pair of side faces coupled to the top and bottom faces and oriented generally perpendicular to a longitudinal axis of the board, and a second pair of side faces coupled to the top, bottom and first pair of side faces, the board configured to receive a first set of effects pedals in the plurality of effects pedals arranged along a first row on the top face of the board and a second set of effects pedals in the plurality of effects pedals arranged along a second row on the top face of the board, and a patch cord coupled to the bottom face of the board and comprising a first end coupled to a first side face in the first pair of side faces of the board and a second end coupled to a second side face in the first pair of side faces of the board, wherein the first end of the patch cord is configured to operably connect to an output of a last effects pedal in the first set of effects pedals and the second end of the patch cord is configured to operably connect to an input of a first effects pedal in the second set of effects pedals, thereby enabling the patch cord to transmit a sound signal from the last effects pedal in the first set of effect pedals to the first effects pedal in the second set of effects pedals.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
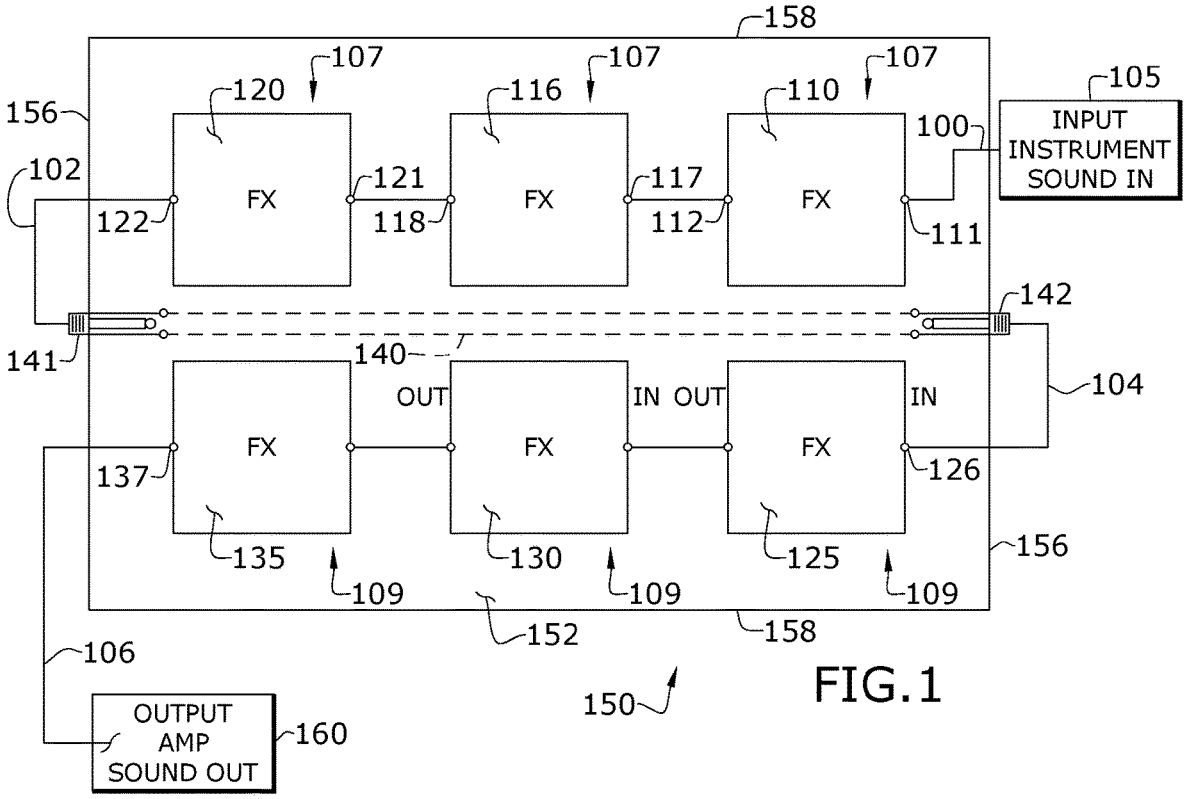
FIG. 1 depicts a top schematic view of certain embodiments of the music pedalboard.

In certain embodiments as depicted in FIGS. 1-2, pedalboard 150 comprises a board configured for use with a plurality of effects pedals including first set of effects pedals 107 and second set of effects pedals 109, which are coupled to the board and operably connected together. First and second sets of effects pedals 107, 109 are operably connected to both musical instrument 105 and amplifier 160 by patch cords as is known in the field.

It shall be appreciated that first and second sets of effects pedals 107, 109 comprise any effects pedals known in the field including, but not limited to, Wah Wah pedals, fuzz pedals, distortion pedals, overdrive pedals, delay pedals, reverb pedals, volume pedals or other effects pedals. In one embodiment, musical instrument 105 is a guitar or bass guitar, but can be any alternative stringed instrument or other type of instrument known in the field.

In one embodiment as depicted in FIGS. 1-2, pedalboard 150 comprises a board having top face 152, bottom face 154, first pair of side faces 156 and second pair of side faces 158. In one embodiment, first pair of side faces 156 is located on opposite sides of pedalboard 150 and is oriented perpendicular to a longitudinal axis of the board. The board can be made from various materials and have variable shapes.

Figure 2A:
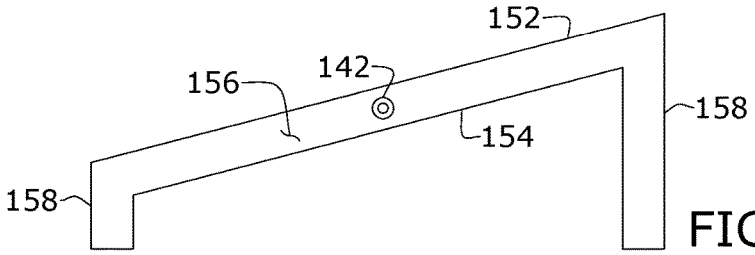
FIG. 2A depicts a right side view of certain embodiments of the music pedalboard.
Figure 2B:
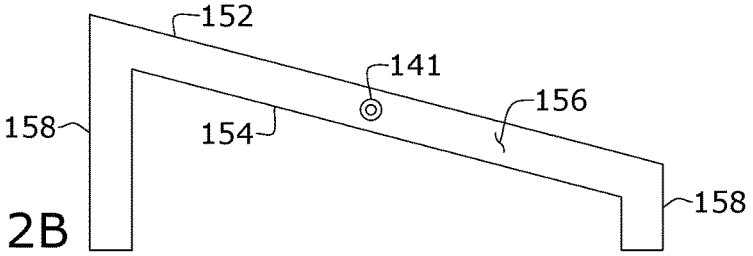
FIG. 2B depicts a left side view of certain embodiments of the music pedalboard.
Figure 3:
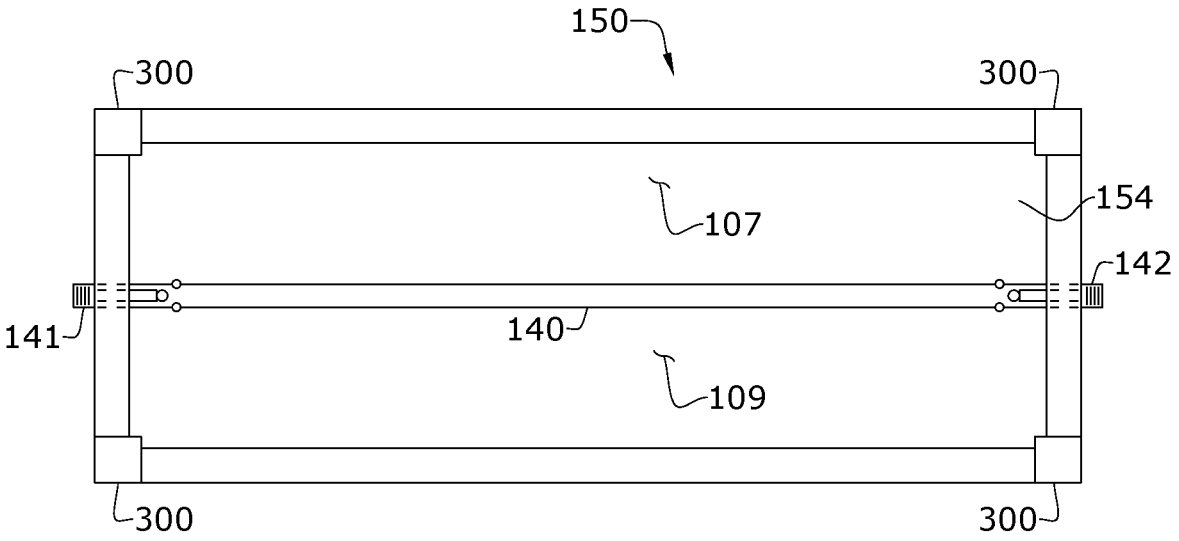
FIG. 3 depicts a bottom view of certain embodiments of the music pedalboard.

In one embodiment as depicted in FIGS. 1-3, built-in patch cord 140 is coupled to bottom face 154 of pedalboard 150 and extends parallel to the longitudinal axis of the board. In a preferred embodiment, built-in patch cord 140 is coupled to bottom face 154 by an adhesive. However, alternative fastening components can be used. In an alternative embodiment, built-in patch cord 140 is embedded within pedalboard 150 between top and bottom faces 152, 154.

In one embodiment, the first end of built-in patch cord 140 is positioned on a first side face in the first pair of side faces 156 on pedalboard 150. The second end of built-in patch cord 140 is positioned on a second side face in the first pair of side faces 156 on pedalboard 150. First and second connectors 141, 142 are coupled to the first and second ends of built-in patch cord 140 and extend to the first pair of side faces 156 as depicted in FIGS. 2A-2B. In one embodiment, each connector in first and second connectors 141, 142 is a female phono jack or plug. In one embodiment, the connectors are ¼" female phono jacks or plugs. However, alternative sized female phono jacks or other types of connectors can be used in other embodiments.

In a preferred embodiment, built-in patch cord 140 is a shielded patch cord with an outer layer such as rubber or another material. Built-in patch cord 140 is wired tip to tip and ring to ring on the phono jacks. The shielded nature of built-in patch cord 140 prevents the transmission of sound signals with added interference such as noise and hum when the cord is in the presence of other electrical devices such as effects pedals, or cords and/or wires.

In one embodiment as depicted in FIG. 1, the plurality of effects pedals is coupled to top face 152 of pedalboard 150 and arranged in separate rows as is commonly performed in the field. In one embodiment, first set of effects pedals 107 comprises first effects pedal 110, second effects pedal 116 and third effects pedal 120 arranged in a first row on pedalboard 150 and connected together in series. In one embodiment, first effects pedal input 111 is operably connected to musical instrument 105 by input patch cord 100. Each adjacent pair of effect pedals in first set of effects pedals 107 is connected together by a separate patch cord as is known in the field. Specifically, first effects pedal output 112 is connected to second effects pedal input 117 by a patch cord. Similarly, second effects pedal output 118 is connected to third effects pedal input 121 by another patch cord. In one embodiment, the patch cord used between each adjacent pair of effects pedals comprises a length of approximately 4", 8" or an alternative length.

Similarly in one embodiment, second set of effects pedals 109 comprises fourth effects pedal 125, fifth effects pedal 130 and sixth effects pedal 135 arranged in a second row on pedalboard 150 and connected together in series. Each adjacent pair of effects pedals in second set of effects pedals 109 is connected together by a separate patch cord in the same manner as previously described in first set of effects pedals 107. In one embodiment, sixth effects pedal output 137 is operably connected to amplifier 160 by output patch cord 106.

In operation, first and second sets of effects pedals 107, 109 are disposed on top face 152 of pedalboard 150 and connected together as previously described in embodiments of the invention. In one embodiment as depicted in FIG. 1, first effects pedal 110 is operably connected to musical instrument 105 and sixth effects pedal 135 is operably connected to amplifier 160.

In one embodiment as depicted in FIG. 1, the last effects pedal in first set of effects pedals 107, third effects pedal 120, is operably connected to first connector 141 on built-in patch cord 140. This is accomplished with the use of first intermediate patch cord 102, which comprises a first end connected to third effects pedal output 122 and a second end connected to first connector 141 of built-in patch cord 140. Similarly, the first effects pedal in second set of effects pedals 109, fourth effects pedal 125, is operably connected to second connector 142 on built-in patch cord 140. This is accomplished with the use of second intermediate patch cord 104, which comprises a first end connected to second connector 142 of built-in patch cord 140 and a second end connected to fourth effects pedal input 126.

In these embodiments, sound signals from musical instrument 105 transmit through effects pedals 110, 116, 120 in first set of effects pedals 107 and the connecting patch cords between the effects pedals to third effects pedal output 122. The transmitted sound signals are altered accordingly depending on the depression of any pedal in effects pedals 110, 116, 120 by a user.

Sound signals from third effects pedal output 122 transmit through first intermediate patch cord 102, first connector 141, built-in patch cord 140, second connector 142 and second intermediate patch cord 104 to fourth effects pedal input 126. The sound signals transmit from fourth effects pedal input 126 through effects pedals 125, 130, 135 in second set of effects pedals 109 and the connecting patch cords between the effects pedals. The transmitted sound signals are altered accordingly depending on the depression of any pedal in effects pedals 125, 130, 135 by a user. Finally, the sound signals at sixth effects pedal output 137 transmit through output patch cord 106 to amplifier 160.

As depicted in FIG. 3, the location of built-in patch cord 140 on bottom face 154 of pedalboard 150 allows the board to serve as a barrier between built-in patch cord 140, and the effects pedals in first and second sets of effects pedals 107, 109 and any connecting patch cords. Ultimately, this location of built-in patch cord 140 on pedalboard 150 combined with the shielded nature of the cord prevent the transmission of sound signals with added interference such as noise and hum due to the presence of other nearby effects pedals, cords and/or wires.

In an alternative embodiment, it shall be appreciated that built-in patch cord 140 is configured to transmit sounds signals in the opposite direction from second connector 142 to first connector 141. Therefore, the order of effects pedals and connections to musical instrument 105 and amplifier 160 can be reversed starting in the location previously designated as the second row on pedalboard 150 and ending on the location previously designated as the first row.

In one embodiment as depicted in FIG. 3, bottom face 154 of pedalboard 150 comprises a plurality of legs 300 to aid the stability of the board on a flat surface.

Although FIGS. 1 and 3 illustrate six effects pedals arranged in two rows with each row having three effects pedals in one embodiment, it shall be appreciated that any alternative number of effects pedals can be arranged in any alternate number of rows with each row having any number of effects pedals on pedalboard 150. In these alternative embodiments, there is a separate built-in patch cord coupled to the pedalboard between each adjacent pair of rows of effects pedals.

Figure 4:
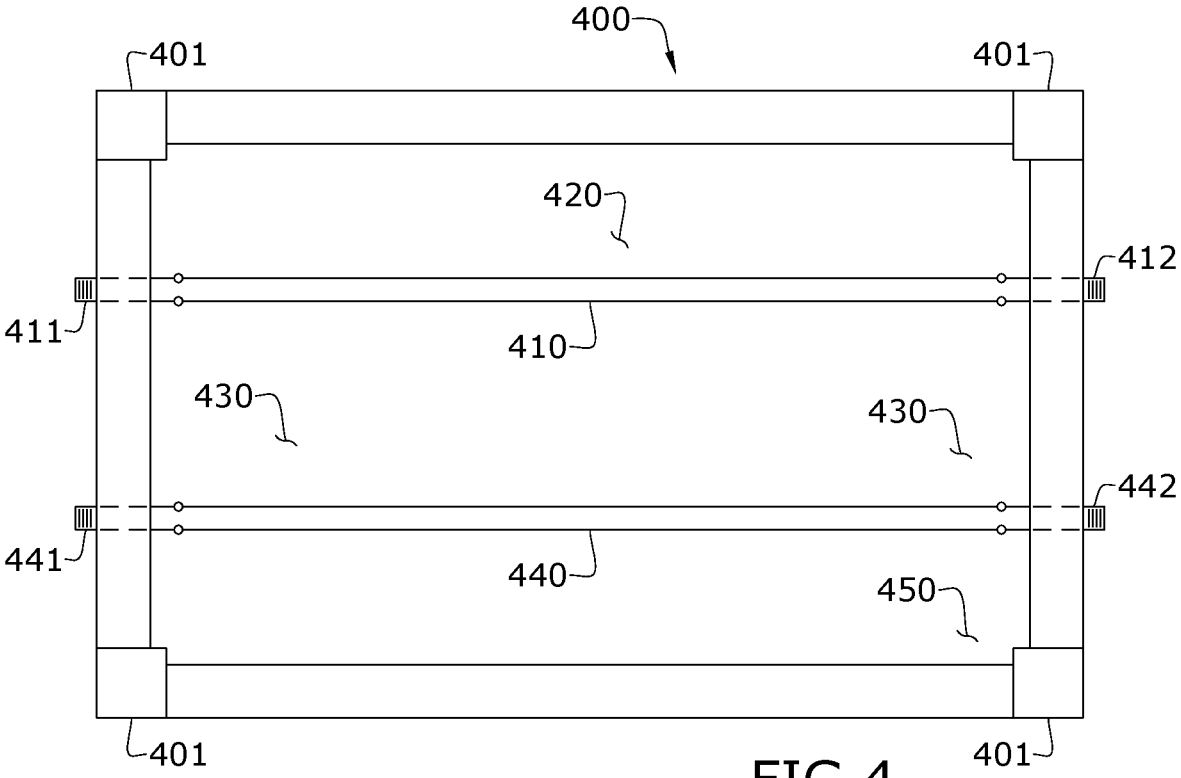
FIG. 4 depicts a bottom view of an alternative embodiment of the music pedalboard.

In one embodiment as depicted in FIG. 4, alternate pedalboard 400 comprises alternate first set of effects pedals 420 arranged in a first row, alternate second set of effects pedals 430 arranged in a second row and alternate third set of effects pedals 450 arranged in a third row on the top face of the board. On the bottom face of alternate pedalboard 400 comprises first built-in patch cord 410 having alternate first connector 411 and alternate second connector 412, and second built-in patch cord 440 having alternate third connector 441 and alternate fourth connector 442. In one embodiment, legs 401 are coupled to the bottom face of alternate pedalboard 400. Alternate pedalboard 400 is operated in the same manner as previously described for pedalboard 150.

It shall be appreciated that the components of the music pedalboard described in several embodiments herein may comprise any alternative known materials in the field and be of any color, size and/or dimensions. It shall be appreciated that the components of the music pedalboard described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A music pedalboard having a built-in patch cord and configured for use with a plurality of effects pedals, the music pedalboard configured to allow the plurality of effects pedals to be coupled thereto and arranged in a plurality of rows on the pedalboard, the pedalboard comprising:

a board comprising a top face, a bottom face opposite the top face, a first pair of side faces coupled to the top and bottom faces and oriented generally perpendicular to a longitudinal axis of the board, and a second pair of side faces coupled to the top, bottom and first pair of side faces, the board configured to receive a first set of effects pedals in the plurality of effects pedals arranged along a first row on the top face of the board and a second set of effects pedals in the plurality of effects pedals arranged along a second row on the top face of the board; and a patch cord coupled to the bottom face of the board and comprising a first end positioned on a first side face in the first pair of side faces of the board and a second end positioned on a second side face in the first pair of side faces of the board;

wherein the first end of the patch cord is configured to operably connect to an output of a last effects pedal in the first set of effects pedals and the second end of the patch cord is configured to operably connect to an input of a first effects pedal in the second set of effects pedals, the patch cord being configured to transmit a sound signal from the last effects pedal in the first set of effect pedals to the first effects pedal in the second set of effects pedals when said first end of said patch cord is operably connected to said output of said last effects pedal in said first set of effects pedals and said second end of said patch cord is operably connected to said input of said first effects pedal in said second set of effects pedals.

2. The music pedalboard of claim 1, wherein the board is configured to serve as a barrier between the first and second sets of effects pedals and the patch cord, thereby reducing interference to the sound signal that transmits through the patch cord.

3. The music pedalboard of claim 2, further comprising a first connector coupled to the first end of the patch cord and positioned on the first side face in the first pair of side faces of the board and a second connector coupled to the second end of the patch cord and positioned on the second side face in the first pair of side faces of the board.

4. The music pedalboard of claim 3, wherein the first connector is operably connected to the output of the last effects pedal in the first set of effects pedals, and the second connector is operably connected to the input of the first effects pedal in the second set of effects pedals.

5. The music pedalboard of claim 4, wherein each connector in the first and second connectors comprises a ¼" female phono jack.

6. The music pedalboard of claim 4, wherein the patch cord is a shielded patch cord.

7. The music pedalboard of claim 6, wherein the patch cord extends generally parallel to the longitudinal axis of the board.

* * * * *